US011160437B2

(12) United States Patent
Bing et al.

(10) Patent No.: US 11,160,437 B2
(45) Date of Patent: Nov. 2, 2021

(54) SELECTIVELY PERMEABLE FLOOR MAT

(71) Applicant: Cintas Corporate Services, Inc., Cincinnati, OH (US)

(72) Inventors: Richard R. Bing, West Chester, OH (US); Patrick J. Chilenski, Cleves, OH (US); David S. Mesko, Wyoming, OH (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 184 days.

(21) Appl. No.: 16/595,811

(22) Filed: Oct. 8, 2019

(65) Prior Publication Data

US 2020/0121161 A1 Apr. 23, 2020

Related U.S. Application Data

(60) Provisional application No. 62/749,333, filed on Oct. 23, 2018.

(51) Int. Cl.
*A47L 23/00* (2006.01)
*A47L 23/26* (2006.01)

(52) U.S. Cl.
CPC ..... *A47L 23/266* (2013.01)

(58) Field of Classification Search
None
See application file for complete search history.

(56) References Cited

U.S. PATENT DOCUMENTS

| | | | |
|---|---|---|---|
| 4,421,809 | A | 12/1983 | Bish et al. |
| 4,482,593 | A | 11/1984 | Sagel et al. |
| 6,774,067 | B2 | 8/2004 | Demott et al. |
| 7,024,721 | B2 | 4/2006 | McKay |
| 7,182,994 | B1 | 2/2007 | Scott |
| 8,318,284 | B2 | 11/2012 | Curro et al. |
| 9,289,085 | B2 | 3/2016 | Thrush |
| 2011/0123758 | A1 | 5/2011 | Pollaud et al. |
| 2016/0257097 | A1 | 9/2016 | Bing et al. |

OTHER PUBLICATIONS

International Searching Authority, International Search Report and Written Opinion, PCT/US2019/55494, dated Dec. 31, 2019, 8 pgs.

*Primary Examiner* — Alexander S Thomas
(74) *Attorney, Agent, or Firm* — Wood Herron & Evans LLP

(57) ABSTRACT

A permeable mat provides a two-state mat; one in which the mat has an impervious layer when laid flat during use, so water gets captured by an upper fabric layer. And a second state in which the mat becomes permeable when it is rolled and tumbled in the washer and drier, to allow the through-flow of air and water to effectively clean and dry the mat. A pattern of permeable elements may be included as part of the rubber backing to improve washing and drying by allowing easier passage through the mat by water and washing chemicals, allowing water drainage through the rubber layer during spinning cycle, reducing the need for very high spinning forces and speeds, allowing for air flow through the mat layers, improving drying time and efficiencies and lowering the structure of the mat unit, thereby allowing for better unrolling and tumbling during washing cycles.

19 Claims, 9 Drawing Sheets

SELECTIVELY PERMEABLE FLOOR MAT

This claims the benefit of U.S. Provisional Patent Application Ser. No. 62/749,333, filed Oct. 23, 2018 and hereby incorporated by reference in its entirety.

BACKGROUND OF THE INVENTION

This invention relates generally to floor coverings and mats and, more specifically, to a mat which is generally impervious to water and fluids in use, but which is breathable or permeable for cleaning and drying.

As people, pets, and objects move from place to place, their feet or wheels often pick up dirt and debris, which is carried along as they move. The dirt and debris are thereby spread to other places, such as the interiors of houses, offices, stores and hospitals. Obviously, it is desirable to prevent the spread of dirt and debris, and many attempts have been made to do so. Chief among these are rugs and mats that are placed in the entryways of homes, offices, stores and hospitals. It is hoped that these rugs or mats will remove and retain some of the dirt and debris from the shoes, feet and wheels of people, pets, and objects. However, this is often not the case. In many situations, these rugs and mats are not frequently or sufficiently cleaned and are themselves a source of dirt and debris. Also, even a clean rug or mat often does a poor job of containing water, snow and debris from feet and wheels. These mats and rugs also preferably remove liquid from feet and wheels. However, they often do an insufficient job of this as well. They may have limited absorption and may also become quickly wetted to the point where they no longer can absorb additional liquid.

In general, both the consumers and flooring manufacturers are concerned with the negative impact of soiling on the appearance of floors and carpets. Carpet manufacturers take many steps to minimize the detractive appearance of soils on carpets through careful selection of fibers, soil release finishes, and colors to either make soils easy to remove or hide their presence. Consumers also employ means to minimize the effects of soiling on their floors and carpets by frequently vacuuming, mopping and sweeping to retrieve soils and fluids. Another means for preserving floor appearance is to trap soils before they are transferred via foot traffic onto permanent floors and carpets. Often this is done with the use of floor mats.

Flocked carpets are known in the art. Flocked mats per se are effective for removing dry soils from the bottom of shoes. Wet soils, however, are another problem. The contact time during which absorption of wet soils takes place is often very short. It is desirable that these floor mats have good wet soil absorption rates such that wet soils can be absorbed from the bottom of a person's shoes during this short time.

Many current commercial floor mats are manufactured by fusing a layer of tufted carpet on top of a sheet of rubber. The final product offers an impervious base layer that prevents the water from flowing through. While this is good for when the mat is in use at a location, it presents a big challenge while being washed and dried at the cleaning facilities. An impervious layer prevents both air and water from flowing through the mat, which forces the cleaning facilities to run washing, spinning and drying cycles that through very extreme forces, temperatures and chemicals try to effectively wash and dry the mat, often with only limited success. In many cases, the mat will not be washed and dried thoroughly and will retain some humidity, which when combined with the conditions during storage or transportation, will more often than not promote mold growth, rot, odors and/or ice on the mat.

One approach to these mat or rug problems is a mat with an absorbent layer which overlies a moisture barrier layer. The absorbent layer absorbs liquid and the moisture barrier layer prevents the liquid from transferring out of the mat. Therefore, the absorbent layer is highly absorbent and retentive of fluid, but is not designed to be walked across as with a normal rug or mat used in an entryway.

Another approach is a floor mat designed for use in entryways. The absorbent layer is designed to be walked across and absorbs liquid and tolerates at least some wiping of shoes. However, such mats have limited capability to grab dirt and debris from the shoes of people walking over the mat.

In light of the above, a need remains for a floor mat or rug which encourages users to "clean" the mat whenever the mat becomes soiled, is capable of tolerating wiping, absorbs liquids, and has the capability to grab and retain dirt and debris.

Moreover, such a mat should be easily and completely cleaned and dried for re-use in an efficient and effective manner.

SUMMARY OF THE INVENTION

These and other objectives of this invention have been attained by a permeable mat, one purpose of which is therefore to provide a two-state mat. One state in which the mat provides an impervious layer when it is laid flat during use, so water gets captured by an upper fabric layer. And a second state in which the mat becomes permeable when it is rolled and tumbled in the washer and drier, to allow the through-flow of air and water to effectively clean and dry the mat.

One embodiment of such a mat has a rubber backing that allows for water and air flow during washing and drying cycles. A pattern may be cut or scored into the rubber backing to improve washing and drying by allowing easier passage through fabric of water and washing chemicals during washing cycle, allowing water drainage through the rubber layer during spinning cycle, reducing the need for very high spinning forces and speeds, allowing for air flow through the fabric and rubber layers, improving drying cycle times and efficiencies and lowering the structure of the mat unit, thereby allowing for better unrolling and tumbling during washing cycles, and improving washing efficiency.

According to various embodiments of this invention, a pattern can be incorporated into the rubber layers during vulcanization by molding the pattern into the press plates, after the rubber has been vulcanized to the fabric layer, and/or by cutting or scoring the rubber layer by any existing means, including the use of a die press, a knife, or a laser to name a few non-limiting examples.

The pattern may include very thin cut slits in the rubber layer. The pattern design may be based on parametric kerf bending, where different shapes, sizes and densities can be cut into the rubber layer. The pattern slits remain closed when the mat is flat on the ground, preventing undesired water drainage, but open once the mat is rolled, lifted, bent or bundled as when it is put through the washing and drying cycles and/or rolled for storage and transport.

When the pattern opens, it allows for air and water flow, improving washing, spinning and drying. As with parametric kerf bending, the pattern can be designed to obtain desired performance like directional folding or selective, discrete structural/non-structural areas.

One example of a parametric kerf is an application of laser-cut lattice hinges in the rubber base layer of the mat. Patterns are parametrically generated along a 3D surface, then flattened to be laser-cut. Kerf-bending is the process of making relief cuts in the rubber base layer to allow it to more easily bend. Lattice hinges apply that concept and are through-cuts made with a laser-cutter or CNC machine. The staggered pattern of cuts creates thin elements that act as torsion springs within the material. A particular curve can be formulated using a few parameters: spring length, spring width, and material thickness. Parametric kerf takes this concept and parametrically applies it to a three dimensional surface.

Another embodiment of this invention is a burst mat which is also a permeable mat. Embodiments according to this concept provide an impervious layer when laid flat on the ground, but the rubber layer of the mat "bursts" open and becomes permeable when tumbled, spun and blasted during the washing and drying cycles. The way it works is by integrally molding a number of features similar to burst valves of varied size, geometry and density of pattern into the rubber layer. When the spinning or tumbling forces experienced by the mat during the cleaning and/or drying process(es) exceed the strength of the overhung material of the burst-valves, the burst-valves will open allowing the flow of water, washing chemicals and air through the mat, thereby increasing the effectiveness and efficiency of both the washing and drying cycles. Such a mat is impervious when flat, but the mat is permeable when non-planar.

Still further embodiments of a mat according to this invention are mats with slits in the rubber layer. When many mats are rolled, they become cylindrical bodies that have significant structure and very rarely un-roll during the washing and drying cycles. When a mat doesn't un-roll, it doesn't allow for the flow of water during washing in between the different layers of rolled mat, preventing an effective wash. And similarly, it prevents the flow of air during the drying cycle, preventing the mat from drying fully.

Therefore, a permeable slit mat according to various embodiments of this invention includes a rubber base layer and a fabric layer, that have been fused together during vulcanization, and in which a number of diagonal slits have been cut in the rubber base layer.

The slits allow the mat to lose its structure when its tumbled in the industrial washing machines, "breaking" the cylinder and effectively un-rolling during the tumbling. The un-rolled mat will then wash and dry more effectively.

These and other embodiments of this invention provide a mat which is effectively impervious as a result of the base layer when laid flat and in use. The mat becomes permeable when it is rolled or non-planar thereby allowing for the passage of fluids through the mat for efficient cleaning and drying of the mat.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
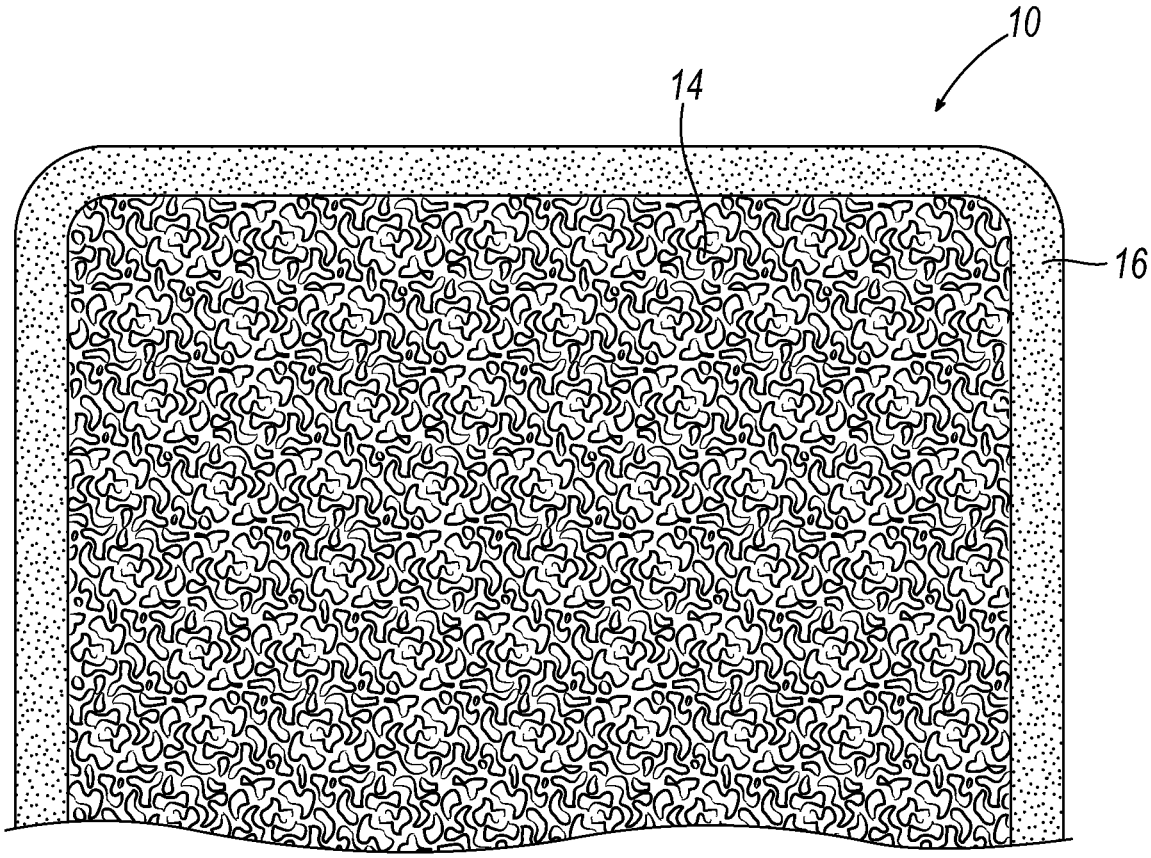
FIG. 1 is a top plan view of one embodiment of a permeable mat according to this invention.

Referring to FIG. 1, one embodiment of a permeable floor mat 10 according to this invention is shown. The permeable floor mat 10 includes a base layer 12 with a layer 14 of tufted carpet on the top of the base layer 12. The base layer 12 in many embodiments may be fused to the upper tufted carpet layer 14. The base layer 12 may be rubber, or any other appropriate material as is well known by those of ordinary skill in this art. The base layer 12 may extend beyond a perimeter of the upper carpet layer 14 as shown in FIG. 1. A perimeter rim 16 of the base layer 12 may be exposed on top of the mat as shown in FIG. 1. A bottom surface 18 of the base layer 12 may be juxtaposed to a floor surface 20 when the mat 10 is in use as shown generally in FIG. 5.

It is well known that when the floor mat 10 is in use, it may accumulate a significant amount of dirt, water, debris, mud or other materials from foot or equipment traffic passing over the mat 10. Therefore, it is common practice to periodically replace each floor mat 10 with a clean floor mat 10 and the soiled floor mat 10 is then washed and dried in an industrial cleaning facility. Due to the heavy and typically rubber construction of the base layer 12 in many embodiments, the ability to effectively tumble and wash the mat 10 is challenging for many commercial washing machines. Moreover, drying the mat 10 is also a challenging task due to the weight and mass of the mat 10 due in large part to the rubber base layer 12. Therefore, extended tumbling cycles, higher drying temperatures and more aggressive cleaning environments are often required to effectively clean and dry traditional floor mats.

Traditionally, the tufted carpet layer is fused on top of the lower base rubber layer and the resulting mat offers an impervious base layer that prevents water and other debris from flowing through the mat. The impervious base layer prevents both air and water from flowing through the mat which forces the processing facilities to run washing, spinning and drying cycles that, through very extreme forces, temperatures and chemicals to try to effectively wash and dry the mat. Unfortunately, the majority of cases with prior art floor mats, the mat will not be washed thoroughly and will retain moisture which will result in the promotion of mold growth, rot, odors and other undesirable conditions when the moist mat is rolled for storage and transport.

According to various embodiments in this invention, the permeable floor mat 10 allows for a passage of water and air and other fluids through the base layer 12 during the cleaning and processing washing and drying cycles. However, when the mat 10 is laid flat on the supporting floor surface 20 and in use, the base layer 12 of the breathable mat 10 according to various embodiments of this invention inhibits or prevents the passage of water and debris through the mat 10 thereby effectively capturing such elements in the tufted carpeted upper layer 14.

Figure 2:
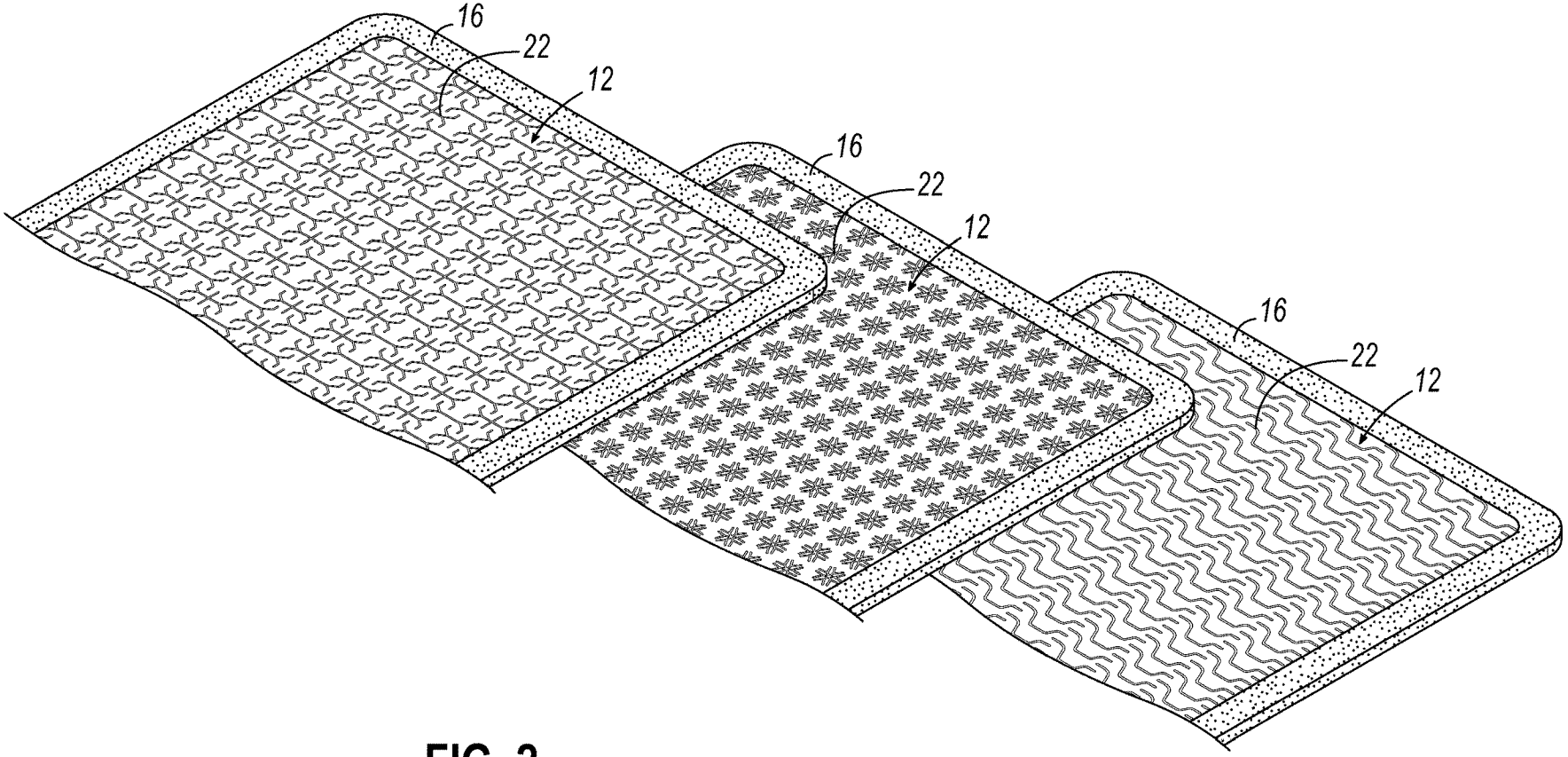
FIG. 2 is a perspective view of three embodiments of a base layer component of the permeable mat according to this invention.

As shown in FIG. 2, various embodiments of a base layer 12 on a permeable mat 10 according to this invention are shown to include permeable elements 22 in the structure of a base layer 12. Such permeable elements 22 may be a pattern of slits or cuts scored into the base layer 12 thereby allowing passage through the permeable mat 10 of water and washing chemicals during cleaning cycles and air during drying cycles. The permeable elements 22 may be incorporated into the base layer 12 during the rubber vulcanization process by molding the pattern into the press plates forming the base layer 12. After the rubber base layer 12 has been vulcanized or fused to the upper layer 14, permeable elements 22 may be added to the base layer via a dye press, a knife, a laser or other means.

As shown in FIG. 2, the permeable elements 22 may be a pattern of discrete elements or may be incorporated into an overall arrangement on the base layer 12 which is continuous throughout the surface area of the base layer 12. The permeable elements 22 may be individual slits of various geometries which may combine with other slits to form the overall pattern in the base layer 12, examples of which are shown in FIGS. 2-3B.

Figure 3A:
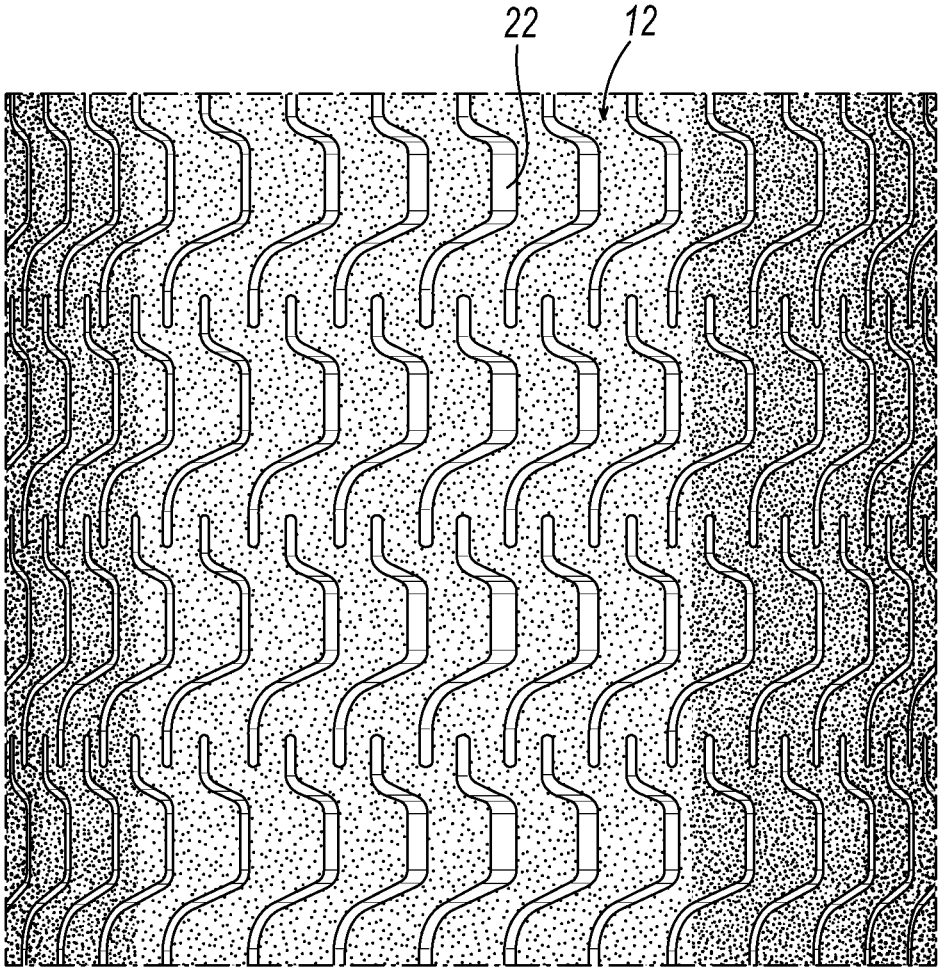
FIGS. 3A and 3B are perspective views of an embodiment of the base layer of the permeable mat according to this invention with a portion of the base layer bent to open a number of selectively permeable elements of the base layer.
Figure 3B:
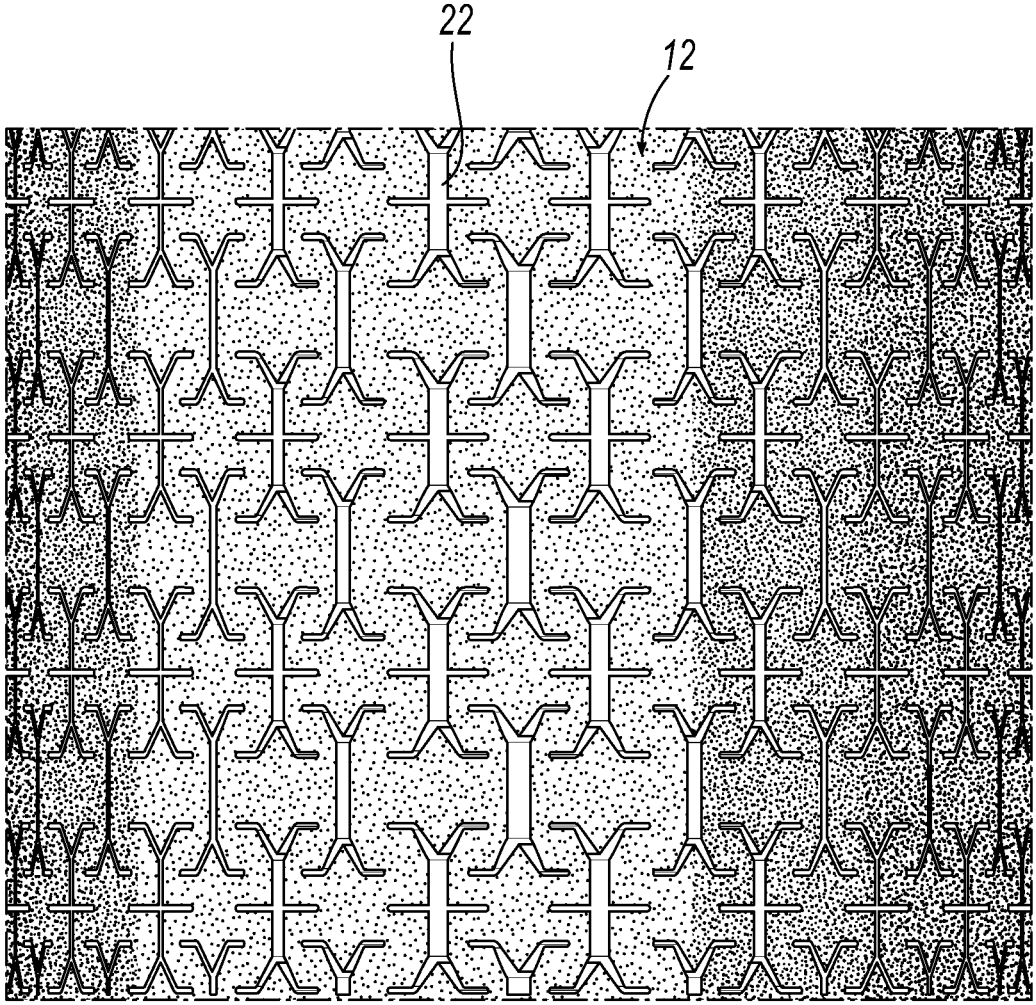

As shown in FIGS. 3A and 3B, the permeable elements 22 when laid flat are generally closed thereby inhibiting or preventing the passage of air, water and other fluids and debris through the base layer 12. However, when the base layer 12 is bent, rolled or otherwise non-planar, the permeable elements 22 separate or open up thereby allowing for the passage of water, fluids, debris and air through the structure of the base layer 12 thereby promoting a more efficient cleaning and drying of the permeable mat 10 according to various embodiments of this invention. The permeable elements may be oriented such that the bending of the mat 10 in a first direction opens certain portions of the slits or permeable elements 22 and bending of the mat 10 in a different direction opens other portions or slits of the breathable elements 22. The pattern of permeable elements 22 may be based on parametric kerf bending, where different shapes, sizes and densities can be cut into the base layer 12. The permeable elements 22 in the form of slits may remain closed when the mat 10 is flat on the ground surface thereby preventing undesired water drainage through the mat 10. However, once the mat 10 is rolled, lifted, bent or contorted as when it is put through the washing and drying cycles, elements 22 or at least certain ones of the permeable elements 22 open thereby allowing for the flow of air, water and other fluids therethrough. One example of permeable elements 22 produced through parametric kerf bending is shown in FIG. 3B.

Figure 4:
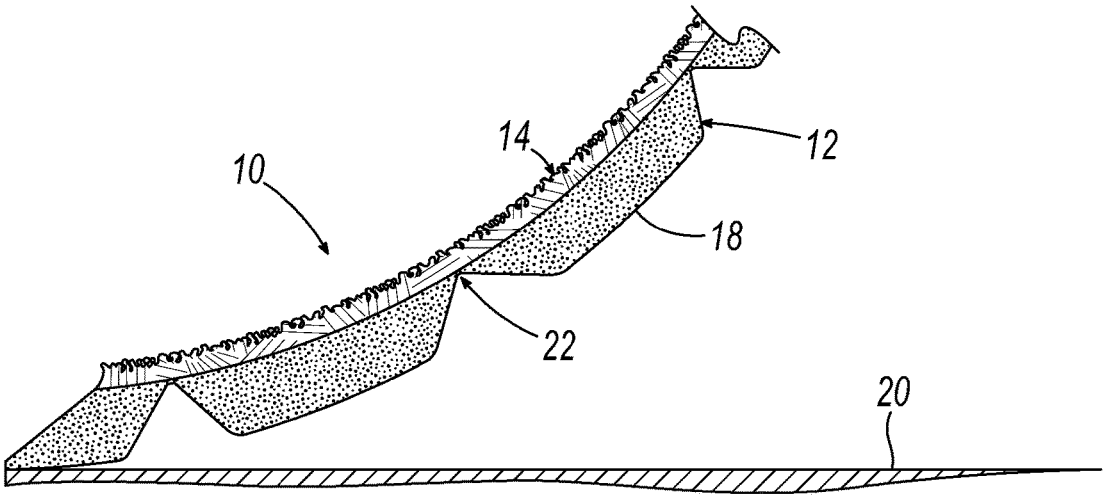
FIG. 4 is a side elevational view of another embodiment of a permeable mat being positioned on a floor surface.
Figure 5:
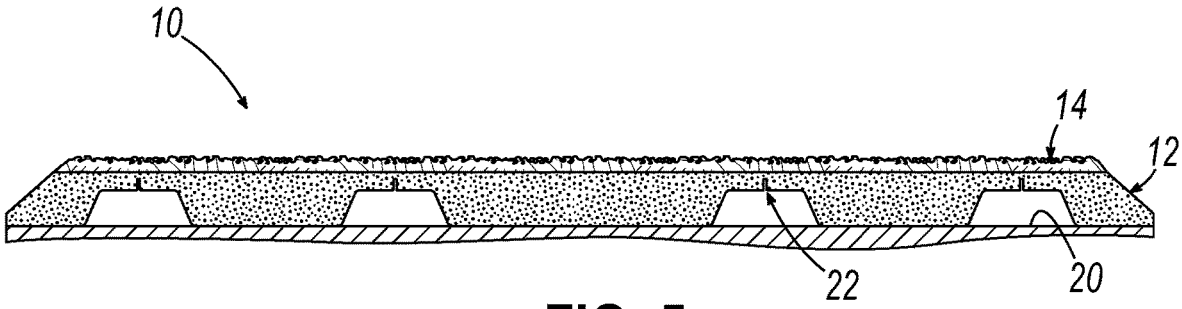
FIG. 5 is a view similar to FIG. 4 with the permeable mat positioned on the underlying floor surface.
Figure 6A:
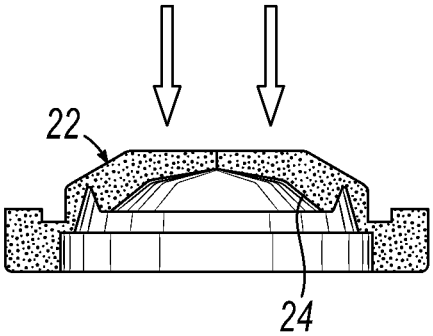
FIGS. 6A and 6B are cross-sectional sequential views of an alternative embodiment of a permeable element opening to allow for the passage of water and fluids therethrough.
Figure 6B:
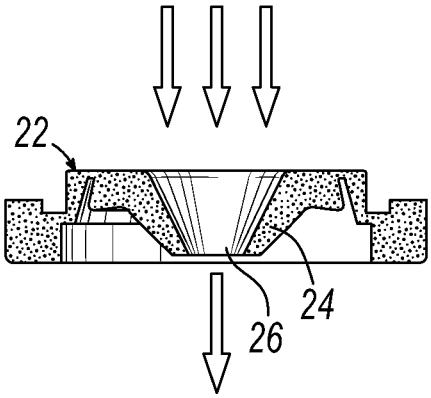

Other embodiments of the permeable mat 10 and associated permeable elements 22 in the base layer 12 according to this invention are shown in FIGS. 4-7B. In FIG. 4, the permeable mat 10 is being laid on the underlying floor surface 20. The base layer 12 of the permeable mat 10 of FIG. 4 includes discrete and spaced permeable elements 22. Each of the permeable elements 22 of the embodiment of the permeable mat 10 according to this aspect of the invention is closed when the mat 10 is laid flat on the underlying surface 20 as shown in FIG. 5. As such, water, dirt and other debris are prevented from passing through the base layer 12 and are contained in the upper fabric layer 14 of the mat 10. In one embodiment, the breathable element 22 is a burst module as shown in FIGS. 6A and 6B. When the burst module is closed, it provides an impervious layer when laid flat on the ground 20. However, when the burst module opens and becomes permeable when tumbled or blasted during the washing and drying cycles thereby allowing for the passage of fluid through the burst module as shown in FIG. 6B. The burst modules may be of various sizes, geometries and densities on the base layer 12 of the permeable mat 10 according to various embodiments of this invention. When the spinning or tumbling forces experienced by the base layer exceed the strength of the overhung component 24 of the burst module, the burst module will open allowing for the flow of fluids through a central orifice 26 of the burst module as shown in FIG. 6B.

Figure 7A:
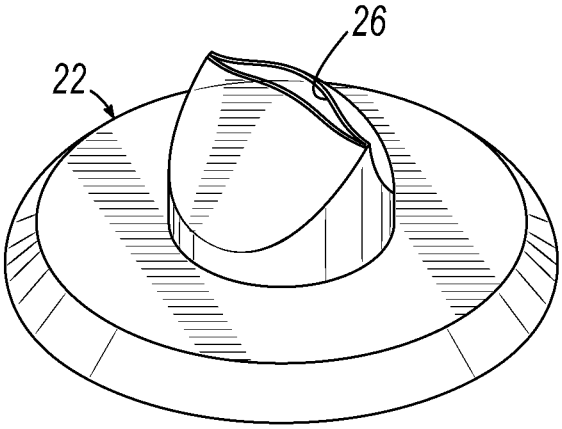
FIGS. 7A and 7B are perspective views of further alternative embodiments of a permeable element opening to allow for the passage of water and fluids therethrough.
Figure 7B:
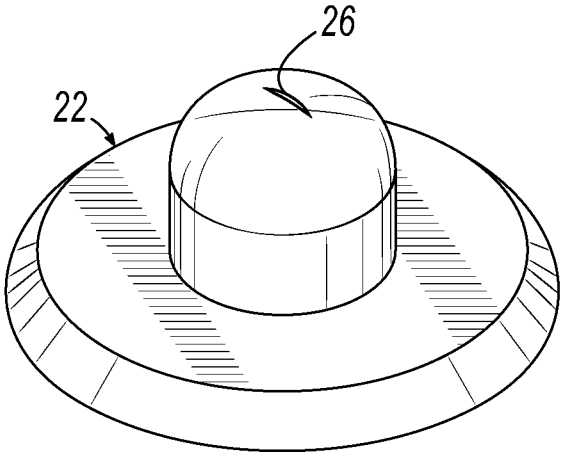

Alternative embodiments of the permeable element or burst module 22 according to various embodiments of this invention are shown in FIGS. 7A and 7B each of which includes a slit, orifice or opening 26 through which fluids may pass when the burst module is open.

Figure 8:
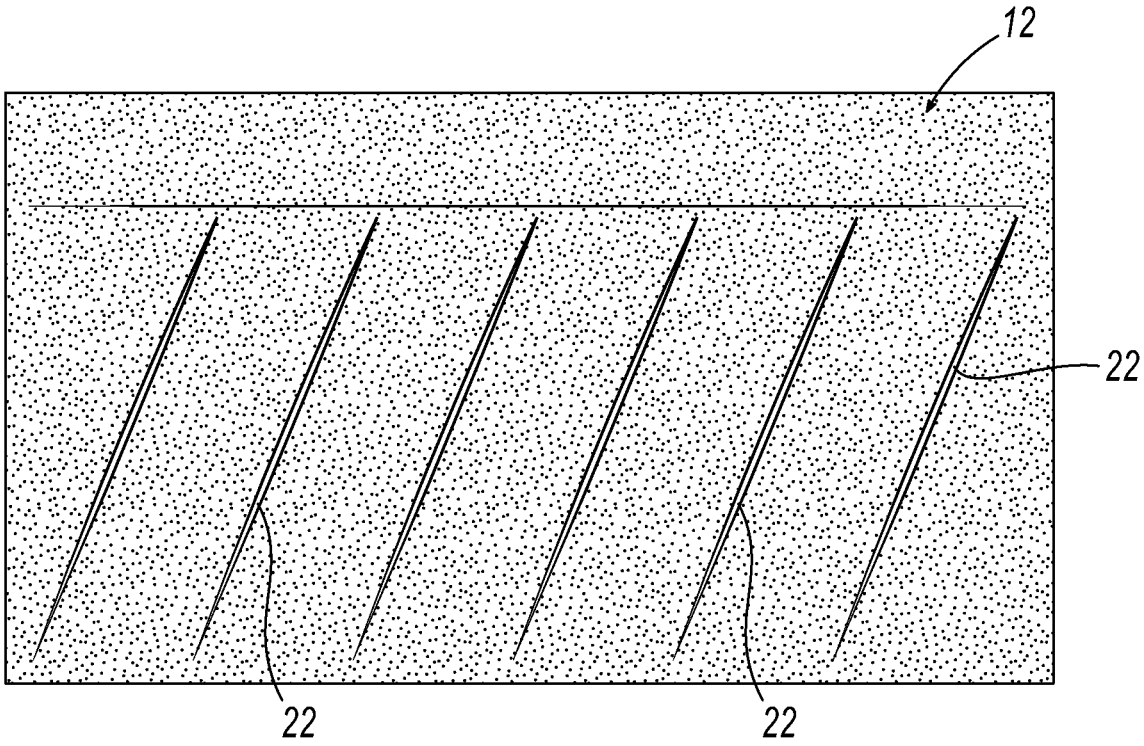
FIG. 8 is a top plan view of a number of selectively permeable elements in the form of slits in the base layer of a breathable mat.
Figure 9:
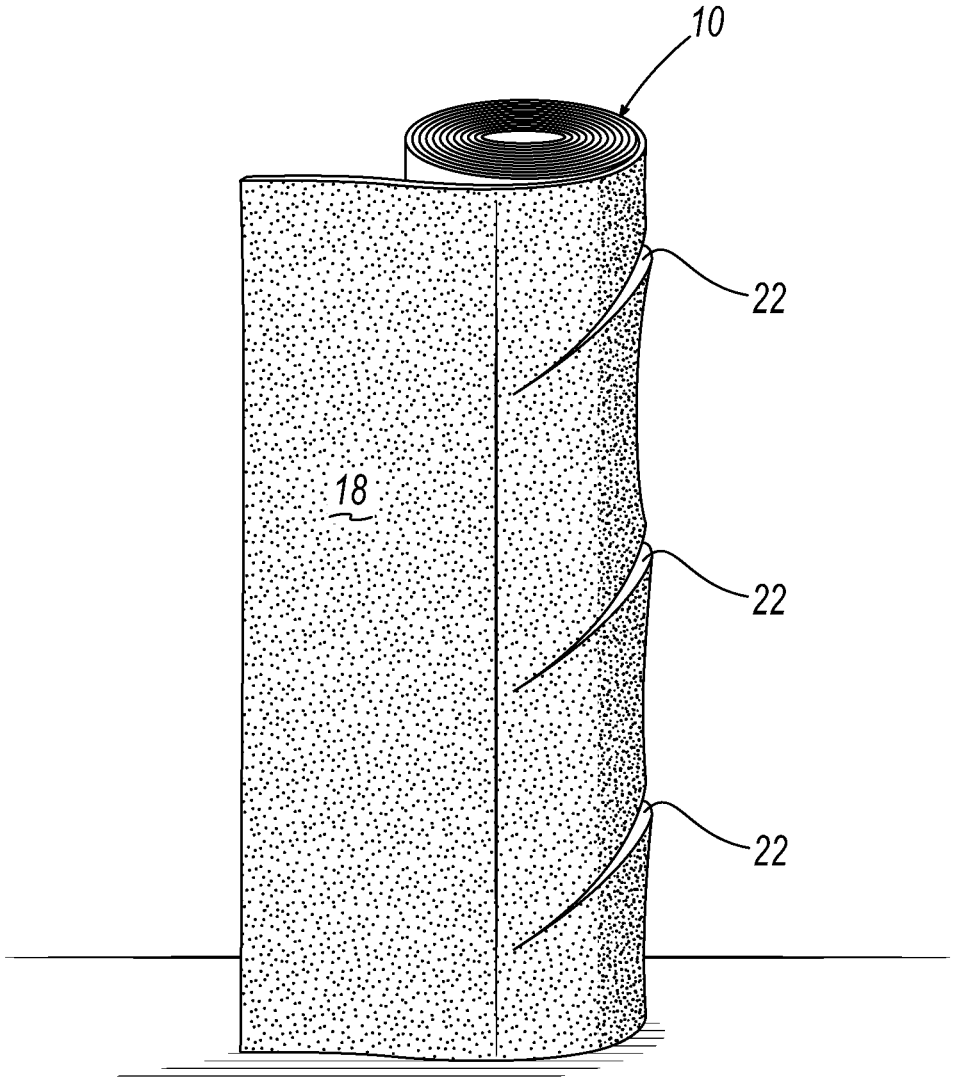
FIG. 9 is a perspective view of a permeable mat opening from a rolled configuration with the slits in the base layer spreading open.
Figure 10:
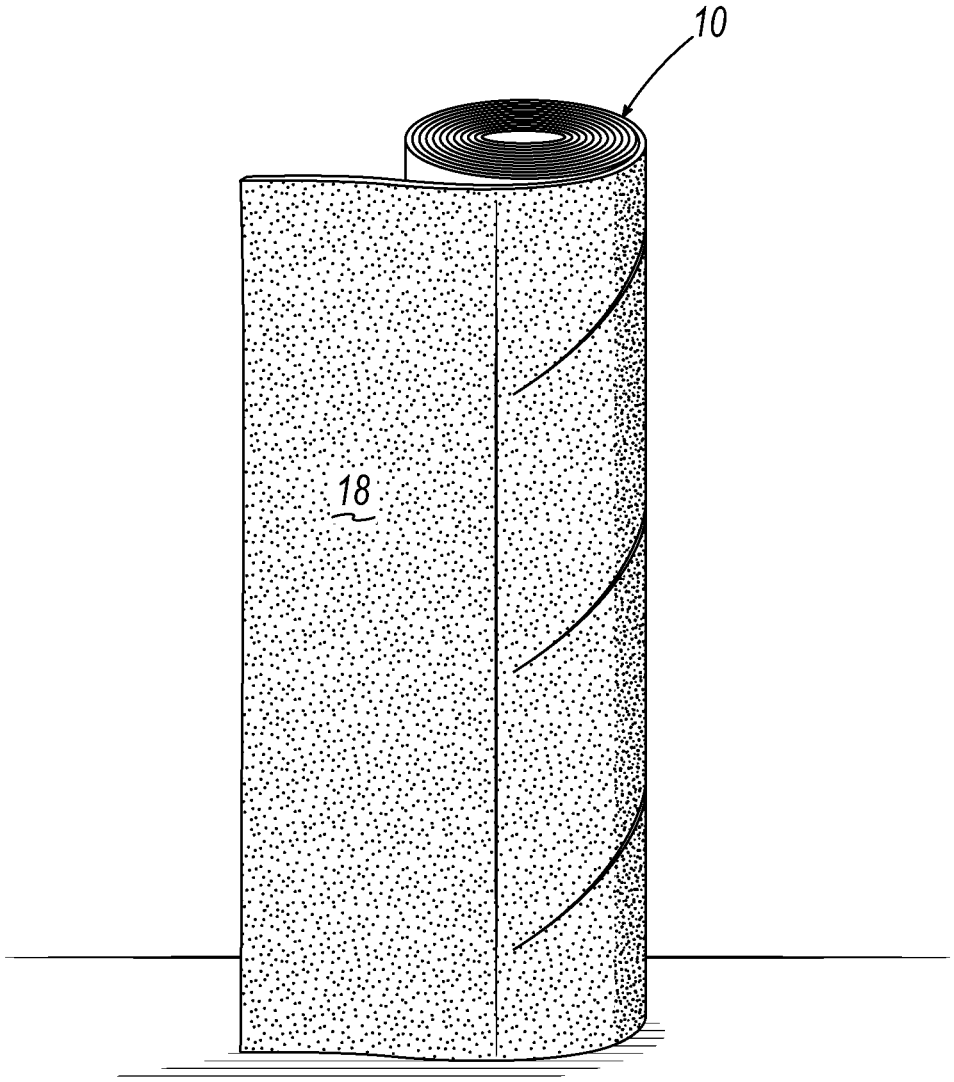
FIG. 10 is a view similar to FIG. 9 with the slits in the base layer closed and the mat maintaining its rolled configuration.

Additional embodiment of the permeable mat 10 according to various aspects of this invention are shown in FIGS. 8-10 in which the permeable element 22 includes a series of individual elongated linear slits oriented generally parallel to each other and orthogonally to the edges of the mat 10 as shown in FIG. 8. When the permeable mats according to this embodiment of the invention are rolled as shown in FIG. 10, they become cylindrical bodies that have significant structure and resist the tendency to unroll during the washing and drying cycles. If the mat 10 does not unroll during the cleaning cycles, it does not allow for the flow of water and air therethrough preventing an effective cleaning process. As such, slits as permeable elements 22 in the mat 10 allows for the mat 10 to lose its structure when it is rolled and tumbled in the industrial washing and drying machines thereby breaking the cylindrical configuration of the mat and promoting unrolling of the mat 10 during the tumbling motion. The unrolled mat 10 will then wash and dry more effectively by allowing the passage of fluids including water and heated air during the washing and drying cycles, respectively. The slits as permeable elements 22 which induce the unrolling of the mat are shown schematically in FIG. 9 according to one aspect of this invention.

It should be appreciated by those of ordinary skill in the art that other permeable elements 22 may be utilized within the scope of this invention which allow for the passage of fluids during the cleaning and drying processes and generally inhibit or prevent the passage of fluids when the mat 10 is laid flat and in use on a supporting ground floor surface 20. Moreover, in various embodiments of this invention the permeable elements 20 are spaced from one another on the mat 10; however, in other embodiments of this invention the permeable elements 20 on a given mat 10 may not be spaced from one another, may be connected, may be continuous, may be discontinuous and/or may be arranged in a variety of configurations, only some of which are shown in the drawings herein.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A floor mat comprising:

a base layer having a lower surface adapted to be juxtaposed to an underlying floor surface in a generally planar configuration;

an upper layer attached to an upper surface of the base layer;

wherein the base layer is capable of being configured in two states, a first state in which the base layer is generally impervious to the passage of fluids therethrough when in the generally planar configuration and a second state in which the base layer provides for the passage of fluids therethrough when in a non-planar configuration; and a plurality of permeable elements in the base layer in which each of the plurality of permeable elements is closed when the base layer is in the first state and at least some of the plurality of permeable elements are not closed when the base layer is in the second state.

2. The floor mat of claim 1 wherein the base layer is rubber and the upper layer is tufted carpet and fused to the base layer.

3. The floor mat of claim 1 wherein the plurality of permeable elements each comprise a slit in the base layer.

4. The floor mat of claim 1 wherein the plurality of permeable elements each comprise a parametric kerf.

5. The floor mat of claim 1 wherein the plurality of permeable elements each comprise a burst element.

6. The floor mat of claim 5 wherein each burst element is moveable in a direction generally perpendicular to the lower surface of the base layer when the mat reconfigures to and between the first and second states.

7. The floor mat of claim 1 wherein the plurality of permeable elements are each spaced from one another.

8. The floor mat of claim 1 wherein at least some of the plurality of permeable elements are spaced from the lower surface of the base layer.

9. The floor mat of claim 1 wherein a first set of the plurality of permeable elements is of a first configuration and a second set of the plurality of permeable elements is of a second configuration which is different than the first configuration.

10. The floor mat of claim 1 wherein the non-planar configuration is with the mat in a rolled configuration.

11. The floor mat of claim 1 wherein fluids are retained atop the base layer when in the first state.

12. A floor mat comprising:

a rubber base layer having a lower surface adapted to be juxtaposed to an underlying floor surface in a generally planar configuration;

a fabric upper layer fused to an upper surface of the base layer;

wherein the base layer is capable of being configured in two states, a first state in which the base layer is generally impervious to the passage of fluids therethrough when in the generally planar configuration and a second state in which the base layer provides for the passage of fluids therethrough when in a non-planar configuration; and a plurality of permeable elements in the base layer in which each of the plurality of permeable elements is closed when the base layer is in the first state and at least some of the plurality of permeable elements are not closed when the base layer is in the second state.

13. The floor mat of claim 12 wherein the plurality of permeable elements each comprise one of a slit in the base layer, a parametric kerf, and a burst element.

14. The floor mat of claim 13 wherein each burst element is moveable in a direction generally perpendicular to the lower surface of the base layer when the mat reconfigures to and between the first and second states.

15. The floor mat of claim 12 wherein the plurality of permeable elements are each spaced from one another.

16. The floor mat of claim 12 wherein at least some of the plurality of permeable elements are spaced from the lower surface of the base layer.

17. The floor mat of claim 12 wherein a first set of the plurality of permeable elements is of a first configuration and a second set of the plurality of permeable elements is of a second configuration which is different than the first configuration.

18. The floor mat of claim 12 wherein the non-planar configuration is with the mat in a rolled configuration.

19. The floor mat of claim 12 wherein fluids are retained atop the base layer when in the first state.

* * * * *